United States Patent [19]

Goins

[11] Patent Number: 4,856,234

[45] Date of Patent: Aug. 15, 1989

[54] OPTICAL LENS MANUFACTURING APPARATUS AND METHOD

[75] Inventor: Gary D. Goins, St. Petersburg, Fla.

[73] Assignee: Research Machine Center, Inc., Grand Rapids, Mich.

[21] Appl. No.: 160,678

[22] Filed: Feb. 26, 1988

[51] Int. Cl.[4] ..... B24B 13/00; B24B 13/005; B24B 31/00

[52] U.S. Cl. ..... 51/284 R; 51/216 LP; 51/217 L; 51/310; 51/313; 279/5; 409/131; 409/221

[58] Field of Search ..... 51/216 LP, 217 L, 284 R, 51/310, 313, 315, 326; 81/176.15, 176.2; 409/131, 165, 166, 168, 221; 279/1 W, 5

[56] References Cited

U.S. PATENT DOCUMENTS

| | | | |
|---|---|---|---|
| 2,237,744 | 4/1941 | Mullen . | |
| 2,981,189 | 4/1961 | Pars | 81/176.15 |
| 3,153,960 | 10/1964 | Allport | 51/217 L |
| 4,267,208 | 5/1981 | Ireland | 51/284 R |
| 4,476,591 | 10/1984 | Arnott . | |
| 4,580,371 | 4/1986 | Akhavi | 51/313 |
| 4,634,441 | 1/1987 | Clayman et al. . | |
| 4,686,798 | 8/1987 | Petty et al. | 51/217 L |

OTHER PUBLICATIONS

Brochure Entitled "BostoMatic Precision CNC Machine Systems-Moldmaker", copright 1986, Boston Digital Corporation, Milford, Mass.

Photograph, D.A.C. Air Bearing Lathe.

Drawing No. A09390 of Air Bearing Lathe Spindle, Federal Mogul Westwind Air Bearings Ltd., Dorset, England, drawing dated Aug. 25, 1982.

*Primary Examiner*—Robert P. Olszewski
*Assistant Examiner*—Jack Lavinder
*Attorney, Agent, or Firm*—Price, Heneveld, Cooper, DeWitt & Litton

[57] ABSTRACT

A carrier is disclosed for holding an optical lens blank while forming optical surfaces on the blank. The carrier includes a clamp for holding the periphery of the lens blank while exposing a central area of the blank. An outer peripheral surface and one of two spaced end surfaces on the carrier are used in a method for locating and positioning said carrier/lens blank in a lathe, milling machine or other machine tool such that the exposed lens blank surfaces may be precisely and accurately cut to form optical lens surfaces with minimal error or misalignment. Holders for mounting the carrier in a lathe or milling machine and having locating surfaces engaging the outer peripheral and one end surface on the carrier are also disclosed.

31 Claims, 4 Drawing Sheets

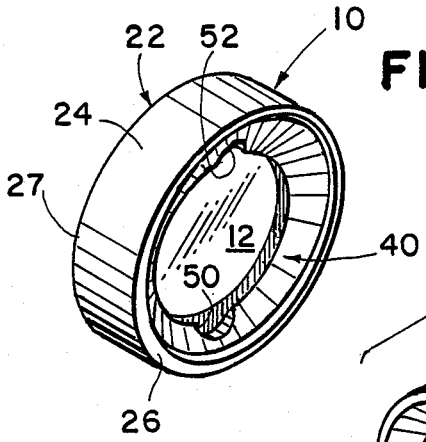
FIG. 1
FIG. 2
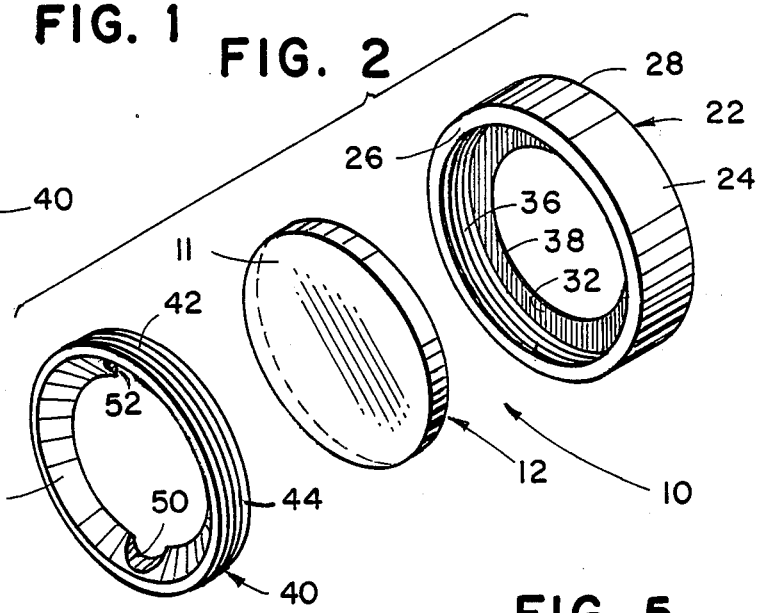
FIG. 5
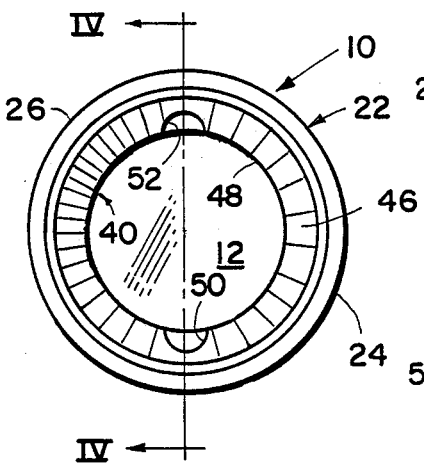
FIG. 3
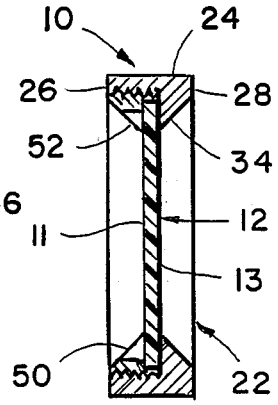
FIG. 4
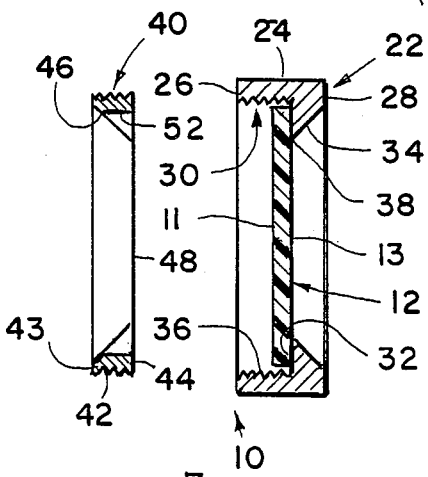
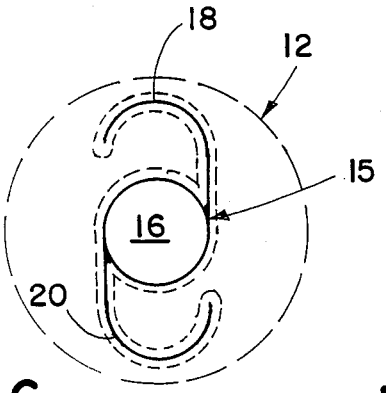
FIG. 6
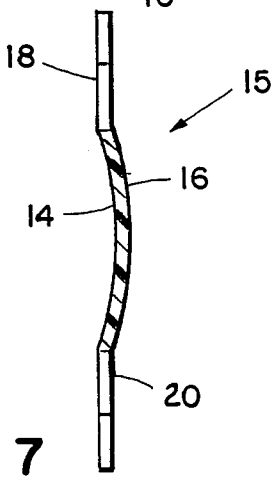
FIG. 7

FIG. 13
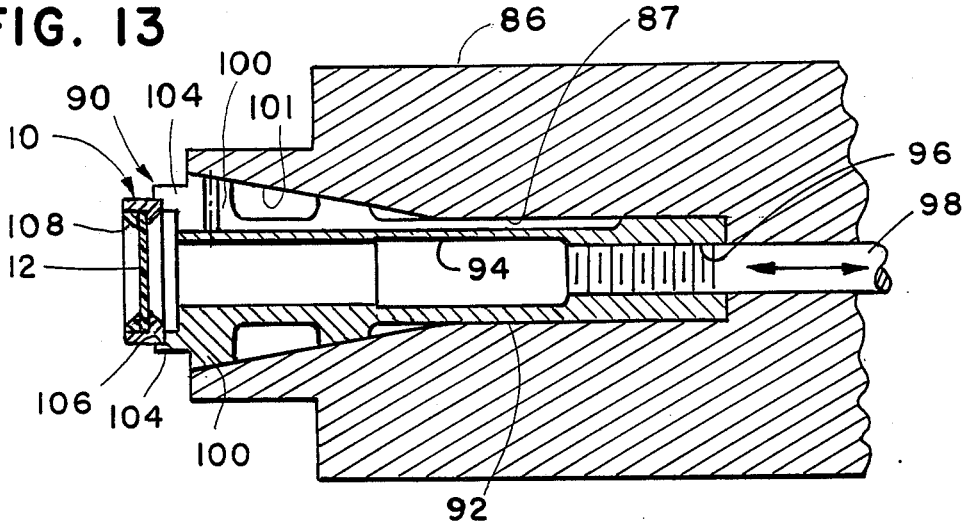
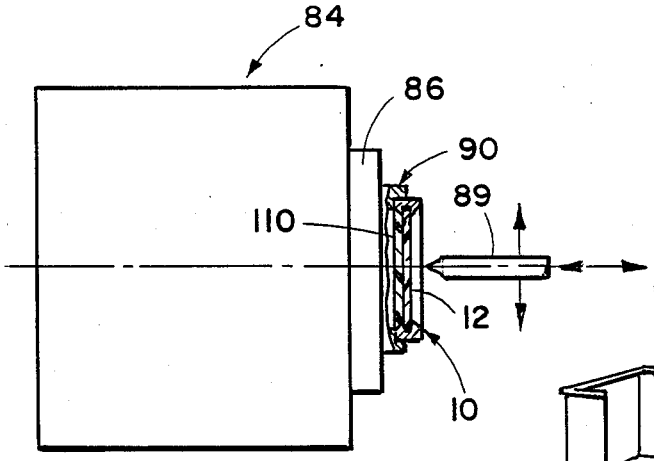
FIG. 14
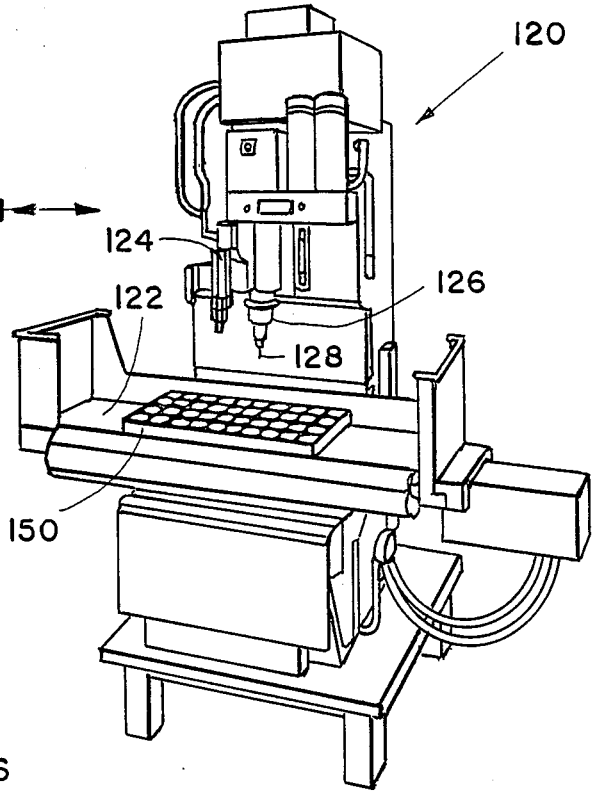
FIG. 15
FIG. 16
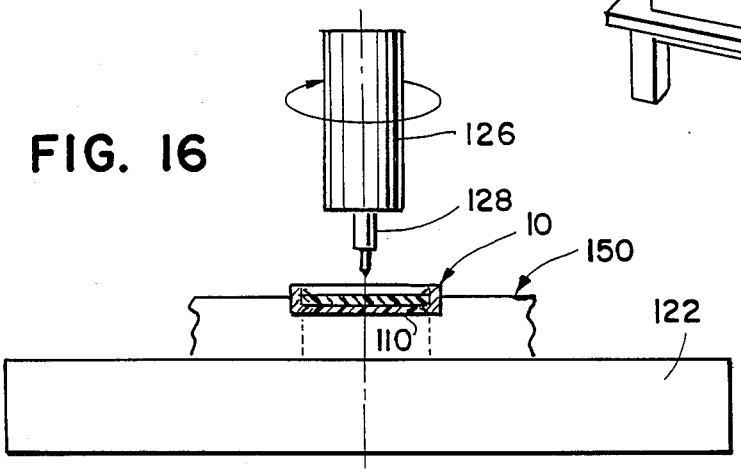

OPTICAL LENS MANUFACTURING APPARATUS AND METHOD

BACKGROUND OF THE INVENTION

This invention relates to apparatus and a method for manufacturing optical lenses and, more particularly, to a carrier for precisely and accurately positioning an optical lens blank in machine tools such as a lathe or milling machine to enable formation of optical surfaces on the lens blank with minimal error or misalignment.

In the optical lens industry, and especially the intraocular lens industry, lenses adapted for substitution in the human eye after removal of a cataract, are currently manufactured using the following method. A disk-shaped lens blank, typically cut from a sheet of transparent optical material, is placed in a vacuum holding device and pressed onto an acrylic, cylindrical holding device commonly referred to as a dopt. A water soluble dental-type wax adheres the lens blank to the end surface of the cylindrical dopt. The dopt/lens blank assembly is then mounted in a lathe and the exposed side of the lens blank is machined or cut with a cutting tool to form the desired curvature for an optical surface. This method often produces significant inaccuracies, however, due to misalignment of the lens blank on the dopt and/or inaccuracies on the surfaces of the dopt on which the blank is secured. Such inaccuracies create improper angular relationships between the cut surface of the lens blank and other surfaces thereof such that the optical center of the lens being formed is misaligned requiring either rejection of the lens before use or resulting in inaccurate vision if used.

Many intraocular lenses also require formation of optical surfaces on a second side of the lens blank which, using the current method, compounds the errors and inaccuracies. After the first side is cut as above, the wax holding the lens blank is dissolved and the blank is transferred and adhered to a second dopt again using wax. The second dopt must have its end surface formed to match the shape of the first optical surface of the lens being made to allow proper support and seating on the second dopt. Thereafter, the second optical surface may be cut with the lathe. This transfer operation often creates misalignment of the optical surfaces and poor optical resolution for the resulting lens since the second dopt surface itself may not be properly prepared, the lens blank may not be centered or secured in exactly parallel position to its position on the first dopt. Consequently, the second optical surface may be formed at an angular position which compounds the inaccurate angular position of the first optical surface. Indeed, the current method results in rejection of more than 20% of the lenses being manufactured. In addition, frequent handling of the lenses during their transfer from dopt to dopt is extremely time consuming and causes scratching on the lens surfaces which adds expense to the process and contributes to the high rejection rates.

Accordingly, the need was apparent for an improved method for manufacturing optical lenses, and especially intraocular lenses, such that the optical surfaces formed on one or both sides thereof were precisely aligned for proper optical resolution in use. A method and apparatus were also desired which would reduce handling of the lenses during manufacture, would save time and expense, and would increase the acceptance rate during lens manufacture.

SUMMARY OF THE INVENTION

Accordingly, the present invention provides an improved method and an apparatus for holding an optical lens blank while forming optical surfaces on one or both sides of the blank during manufacture of an intraocular or other optical lens. The apparatus includes a carrier for holding the lens blank while exposing a portion of that lens blank for cutting and machining operations. The carrier provides locating and positioning surfaces which enable exact and precise alignment of the lens blank surfaces for cutting and machining. The carrier is also combined with a holder for retaining and positioning the carrier in a lathe, milling machine or other machine tool. The method includes locating and positioning the carrier/lens blank combination in a machine tool so that the optical surfaces may be precisely and accurately formed with minimal misalignment or error.

In one aspect, the invention is a carrier for holding an optical lens blank while optical surfaces are formed on the blank including a rigid body having an outer peripheral surface, first and second spaced end surfaces, an inside surface defining an aperture extending through the body and lens blank holding means on the rigid body for holding at least portions of the periphery of the lens blank within the body such that the central area of the lens blank is exposed by the aperture for performing operations to form optical surfaces thereon.

Preferably, the rigid body is annular with the outer peripheral surface being cylindrical and the end surfaces being parallel and extending at right angles to the cylindrical outer surface. Further, the annular body preferably includes an annular clamping ring threaded into one side of the carrier body to clamp the periphery of the lens blank. A tool for tightening the clamping ring in the carrier body is also disclosed.

In another aspect of the invention, the carrier is combined with a holder for retaining and positioning the carrier in a lathe, milling machine or other machine tool. The holder includes a central axis, a first locating surface for engaging and locating one end surface of the carrier body and a second locating surface for engaging and locating the outer peripheral surface of the carrier body. For a lathe, the holder is a collet chuck with a series of chuck segments with radially and axially extending locating surfaces engaging the peripheral and end surfaces of the carrier to grasp, hold and properly position the carrier and lens blank for optical surface forming. In a milling machine, the holder is a fixture having a plurality of carrier/lens blank positioning recesses also having locating surfaces engaging the peripheral and end surfaces of the carrier.

In yet another aspect, the invention is a method for manufacturing an optical lens from a lens blank comprising positioning and holding an optical lens blank in a rigid carrier having an outer peripheral surface and first and second parallel end surfaces such that opposite sides of a predetermined area of the lens blank are exposed by the carrier. The carrier with the lens blank therein is mounted on a rotating support having a rotational axis using one of the end surfaces and the outer peripheral surface to locate and position the carrier such that one of the exposed sides of the lens blank faces outwardly. An optical surface is cut in the outwardly facing lens blank surface with a cutting tool whereby the optical surface is precisely and accurately formed with respect to the rotational axis.

The method may also include repositioning the carrier and lens using the outer peripheral surface and the other end surface of the carrier so that the opposite side of the lens blank may be cut. The preferred method also includes mounting the carrier on a profile milling machine after one or both optical surfaces have been formed to cut the lens out of the blank.

Accordingly, the present invention provides an optical lens forming apparatus and method which reduces lens handling, saves time, reduces scratching and imperfections in the lenses, and increases alignment of the formed optical surfaces on the completed lens. Concentricity and alignment of the lens optical surfaces are improved resulting in better optical resolution. In addition, the method is significantly more error free than prior known methods and greatly reduces rejection rate of manufactured lenses.

These and other objects, advantages, purposes and features of the invention will become more apparent from a study of the following description taken in conjunction with the drawings.

BRIEF DESCRIPTION OF THE DRAWINGS

FIG. 1 is a perspective view of the carrier assembly of the present invention used to hold an optical lens blank during lens manufacturing;

FIG. 2 is an exploded perspective view of the carrier assembly and lens blank of FIG. 1;

FIG. 3 is an end elevation of the carrier assembly of FIGS. 1 and 2;

FIG. 4. is a sectional side elevation of the carrier assembly and lens blank taken along plane IV—IV of FIG. 3;

FIG. 5 is an exploded, sectional, side elevation of the carrier assembly with the annular clamping ring removed;

FIG. 6 is an enlarged, plan view of a lens blank showing the outline of a typical intraocular lens including positioning haptics thereon;

FIG. 7 is an enlarged, sectional side elevation of a typical intraocular lens after formation with the apparatus and method of the present invention;

FIG. 13 is a sectional side elevation of the collet chuck of FIG. 12 when mounted in the rotatable spindle of the lathe of FIG. 11:

FIG. 14 is a schematic illustration shown partially in section of the carrier and cutting tool on the lathe of FIG. 11;

FIG. 15 is a perspective view of a numerically controlled, vertical, profile milling machine suitable for use in performing the manufacturing method of the present invention;

FIG. 16 is a fragmentary front elevation of the milling head, carrier holding fixture and movable support table of the milling machine of FIG. 15;

DESCRIPTION OF THE PREFERRED EMBODIMENTS

Figure 8:
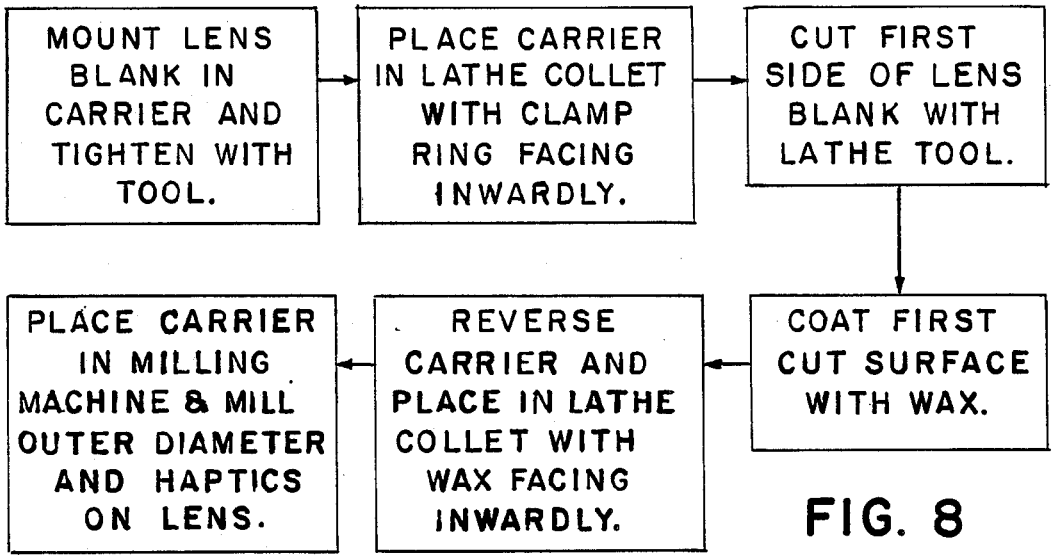
FIG. 8 is a schematic illustration of the preferred manufacturing method of the present invention.

Referring now to the drawings in greater detail, FIGS. 1–5 illustrate a carrier assembly 10 adapted for holding and locating an optical lens blank such as that shown at 12 in a machine tool. The machine tool may be a lathe 80 (FIGS. 11–14) or a milling machine 120 (FIGS. 15–18). Carrier assembly 10 is especially adapted to precisely and accurately hold lens blank 12 during machining operations which are performed with the method of the present invention to form and/or cut a lens 15 (FIG. 6) with highly accurate, aligned, optical lens surfaces 14, 16 (FIG. 7) on one or both sides of the lens blank 12 as described below.

Preferably, lens blank 12 is a circular disk cut from a sheet of optical grade, transparent, polymethylmethacrylate (PMMA) of a thickness within the range of about 1.5 to about 2.5 mm and having opposed, substantially planar, substantially parallel side surfaces 11, 13 in which optical surfaces 14, 16 of completed lens 15 are later formed. A preferred sheet material for lens blank 12 is polymethylmethacrylate sold under the trademark PERSPEC CQ - CLEAR 001 by Industrial Chemical Industries of Blackpool, England. Of course, other optical grade acrylics or polycarbonate could also be used. As is shown in FIGS. 6 and 7, which illustrate a one-piece concave-convex intraocular lens formed with the present method, a completed lens may include formed haptics or positioning elements 18, 20 extending tangentially from opposite sides of the circular central lens portion for positioning the lens in the cornea envelope of a human eye during implant surgery. Front optical surface 16 is a convex surface while rear optical surface 14 is a concave surface both of which must be formed accurately and precisely with respect to one another to provide proper optical resolution and acuity for the wearer after implantation. The present lens forming apparatus and method provide a significantly improved, more efficient manufacturing capability which greatly reduces rejection rate of lenses such as those shown at 15.

As shown in FIGS. 1–5, a preferred form of the carrier assembly 10 includes a rigid, annular body 22 preferably formed from No. 303 stainless steel having a cylindrical outer peripheral surface 24, spaced, parallel annular end surfaces 26, 28 and an inside surface 30. Surface 30 includes multiple sections including a radially extending, annular lens retaining surface 32 which extends parallel to end surfaces 26, 28, an angled surface portion 34 which extends on an angle between end surface 28 and the radially inner edge of annular lens retaining surface 32, and threaded inside surface section 36 which extends substantially parallel to circumferential surface 24 between end surface 26 and lens retaining surface 32. The convergence of angled surface 34 with lens retaining surface 32 defines an aperture 38 providing an opening through body 22. Threaded inside surface 36 has a diameter larger than the edge of aperture 38 which defines a threaded circular aperture leading to lens retaining surface 32 from end surface 26. The diameter of surface 36 enables insertion of disk-like lens blank 12 against lens retaining surface 32 as explained below.

Figure 9:
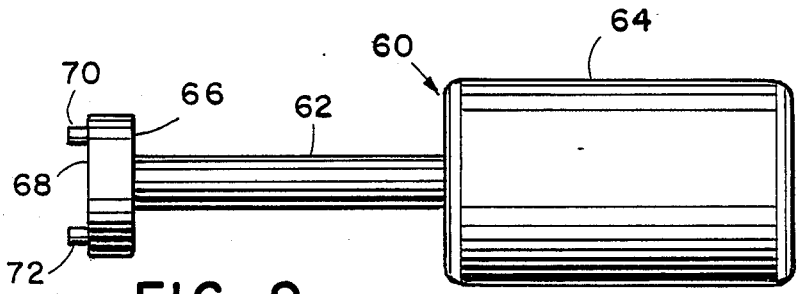
FIG. 9 is a side elevation of the tightening tool used with the carrier assembly of the present invention.
Figure 10:
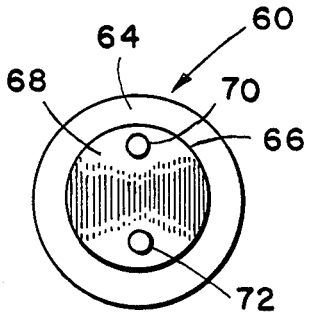
FIG. 10 is an end elevation of the tightening tool of FIG. 9.

The second component of carrier assembly 10 is annular clamping ring or lens retaining member 40. Ring 40 is generally triangular in section and includes a threaded, axially extending outer peripheral surface 42, generally planar, radially extending end surfaces 43 and 44 extending at right angles to the general direction of threaded surface 42, and an angled inside surface 46 which extends at an angle from end surface 43 toward end surface 44 to define aperture 48 extending through the clamping ring 40. Aperture 48 is equivalent in diameter to aperture 38. As shown in FIGS. 1–5, clamping ring 40 is threaded into threaded surface 36 adjacent end surface 26 after lens blank 12 has been inserted against lens retaining surface 32. Ring 40 is screwed inwardly against the exposed side 11 of lens blank 12, typically by hand, after which it may be securely tightened using a tightening tool 60 as shown in FIGS. 9 and 10.

Tightening tool 60 is intended to engage semi-circular recesses 50, 52 formed at diametrically opposed positions on the inside edge 48 of ring 40 (FIGS. 1–3). Tool 60 includes a cylindrical shaft 62 having an enlarged, cylindrical handle 64 at one end. Handle 64 is easily grasped by hand and rotated about the longitudinal axis of shaft 62. A circular, disk-like plate 66 is welded or otherwise fixed perpendicularly with respect to the longitudinal axis of shaft 62 at the end of shaft 62 opposite handle 64. On the outwardly facing surface 68 of plate 66 are a pair of diametrically opposed, spaced, dowel projections 70, 72 each of which is cylindrically shaped. Projections 70, 72 each have a diameter corresponding to the diameter of semi-circular recesses 50, 52 in clamping ring 40.

When projections 70, 72 are received in recesses 50, 52, the outer periphery 24 of carrier assembly 10 may be grasped with one hand while tool 60 is held by handle 64 with the other hand. Torque is applied to the ring 40 such that it is securely tightened via threaded surfaces 36, 42 against side 11 of lens blank 12. In this manner, lens blank 12 is securely retained in position intermediate the end surfaces 26, 28 and prevented from axial or radial movement or rotation by the frictional engagement of surfaces 44, 32. Also, as is best shown in FIG. 4, when so tightened, clamping ring 40 is flush or recessed with respect to end surface 26. This allows end surface 26 to provide proper location and positioning of the carrier assembly 10 when received in a machine tool such as lathe 80 or milling machine 120 described below.

Further, sheet-like lens blank 12 is positioned substantially parallel to end surfaces 26, 28 via the locating and positioning retaining surface 32. Consequently, positioning and location of the carrier assembly using end surfaces 26, 28 will properly position and locate surfaces 11, 13 of lens blank 12 which are exposed for machining operations from either side of carrier assembly 10 via apertures 38, 48 while the periphery of lens blank 12 is firmly and securely held by the clamping force of ring 40.

It Will be understood that carrier 10 could be of configurations other than annular such as square. This would enable it to fit other chucks or holding devices used in machine tools having shapes other than circular. Likewise, surfaces 24, 26 and 28 may be positioned at other than perpendicular angles to one another depending on the position of the locating surfaces in the chuck or machine tool. Further, other types of securing assemblies beside threads 42 on ring 40 and inside surface 36 could be used such as bayonet mounts, wedge-type recesses and projections or the like.

Referring now to FIGS. 11–14, a suitable computer operated, numerically controlled air bearing lathe 80 of the type which is useful in the present method is shown. A suitable lathe is that sold by D.A.C. of Carpinteria, California which incorporates an air bearing spindle, is computer operated, and is numerically controlled. Lathe 80 includes a support platform 82 on which are mounted a housing 84 supporting a water cooled, electrically operated, air bearing supported, high speed rotating spindle or shaft 86 capable of providing up to 30,000 rpm about the shaft axis. A suitable spindle is manufactured by Federal Mogul Westwind Air Bearings Ltd. of Dorset, England under Product No. 1068. Supported adjacent spindle 86 on platform 82 is a rotatable, reciprocable cutting tool support 88 which may be moved on three axes and typically supports a diamond tipped cutting tool 89 shown schematically in FIG. 14. Cutting tool 89 may be pressed against the exposed surface of the lens blank 12 which is mounted in carrier assembly 10 and rotated by air bearing lathe 80 to provide highly precise, accurately controlled cutting of optical surfaces in the exposed area of the blank.

Figure 12:
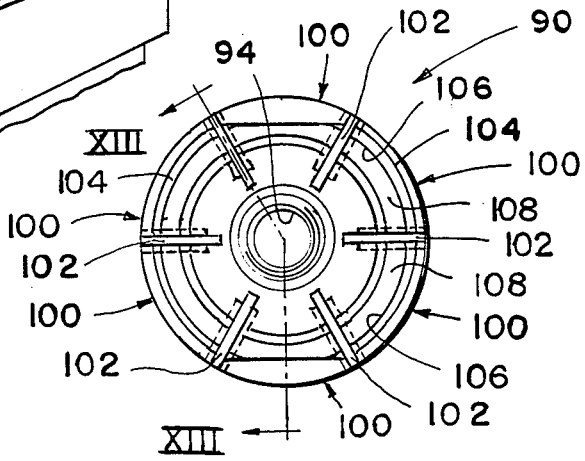
FIG. 12 is an end elevation of an expandable, self-centering collet chuck useful for holding the carrier assembly of the present invention in a lathe such as that shown in FIG. 11.

As shown in FIGS. 12 and 13, air bearing, rotatable spindle 86 includes a self-centering, collet chuck 90 mounted for reciprocation within bore 87 in the spindle to grasp, hold, position and locate carrier assembly 10 when mounted therein. Collet chuck 90 includes a cylindrical shaft 92 having a central longitudinal axis and an internal longitudinal bore 94 which is threaded at the interior end 96 to receive a reciprocating, air pressure operated rod 98 for sliding collet chuck 90 into and out of bearing spindle 86. The outer end of collet chuck 90 has a conical shape formed by six tapered chuck segments or jaws 100 spaced equally about the central axis as shown in FIG. 12. Chuck segments 100 are separated by longitudinally extending, radial spaces 102 such that the individual chuck segments may flex in a radial direction with respect to the central axis of shaft 92 when collet chuck 90 is moved into or outwardly away from spindle 86. Each chuck segment 100 includes a cylindrical, circular projection 104 the inside surfaces of which, when combined with the inside surfaces of the other chuck segments 100, locate and position carrier assembly 10 for accurate rotation and formation of optical surfaces on lens blank 12.

As is best seen in FIG. 13, the inside surfaces of each chuck segment 104 include an axially extending cylindrical surface 106 and a radial, substantially planar surface 108 which extends perpendicularly with respect to axial surface 106. Axial and radial surfaces 106, 108 respectively engage, position and locate the outer peripheral cylindrical surface and one of the parallel end surfaces 26, 28 of carrier assembly 10 such that lens blank 12 is positioned perpendicular to and is centered with respect to the central rotational axis of shaft 92.

Mounting of carrier assembly 10 in collet chuck 90 is accomplished by activating air pressure to slide rod 98 and collet chuck 90 partially out of spindle 86 (to the left in FIG. 13) which, because of the flexibility and resiliency of jaw segments 100, increases the size of the circular recess formed by surfaces 106, 108. Carrier assembly 10 is then placed inside surfaces 106 in a position in which end surface 26 or 28 is against surfaces 108. Preferably end surface 28 faces outwardly first so that the first optical surface is formed on side 13 of blank 12. Thereafter, air pressure is released to draw collet chuck 90 and rod 98 inwardly of spindle 86. This forces the tapered outer surfaces of chuck segments 100 against conical bore 101 in spindle 88 and urges them radially inwardly to securely clamp surfaces 106 against outer peripheral surface 24 of the carrier assembly. Accordingly, when spindle 86 is rotated, carrier assembly 10 and, thus, lens blank 12 are properly centered on the rotational axis of the lathe spindle perpendicular to the axis of rotation of the spindle for accurate optical surface cutting.

After cutting of the first surface 13 of lens blank 12 to form an optical lens surface, carrier assembly 10 with lens blank 12 may be reversed and remounted in collet chuck 90 for cutting of the second side 11 of the lens blank. Alternately, it may be removed and placed in a milling machine depending on whether that second side of the lens blank must be left substantially planar or formed with a curved optical surface. If the second side need not be cut and will be left planar, a coating 110 of water soluble dental-type wax, preferably about 0.100 inches thick, is applied to side 11 of the lens blank (FIGS. 14, 16 and 18) which has already been formed with an optical surface. Wax layer 110 fills the recess below and within end surface 28 and against inside surface 34 of the carrier assembly. Preferably, wax 110 is an optical quality, water soluble wax sold under Product No. 18423 by Kerr Manufacturing Corporation of Romulus, Michigan. Application of wax coating 110 to the side of annular carrier body 22 against inside surface 34 avoids obstruction of threaded clamping ring 40 which is fitted against the opposite side of the lens blank. The wax coating on side 11 of lens blank 12 protects the cut, finished optical surface 16 on the lens blank after formation and provides a backup for the lens blank 12 which has been made thinner during initial cutting thereby strengthening it during any operations carried out on the second or opposite side 13. The wax also holds completed lens 15 securely in place while it is being cut out of the lens blank during the profile milling operation described below.

As shown in FIGS. 15–18, intraocular lens 15 (FIGS. 6 and 7) is preferably cut from lens blank 12 after wax 110 has solidified using a vertical, profile milling machine such as that shown at 120. Preferably, milling machine 120 is a computer operated, numerically controlled mill of the type sold under the trademark "BostoMatic 300" by Boston Digital Corporation of Milford, Mass. Milling machine 120 includes a movable, workpiece positioning table 122 which may be moved on three orthagonal axes to properly position a workpiece under milling head 124. The milling head has a high speed spindle 126 which rotates on a vertical axis and holds a profile milling tool or cutter 128 in an adjustable chuck. Rotating spindle 126 preferably is water cooled and driven at rotational speeds of about 7,000 to 10,000 rpm by an electric motor to perform 15 milling, drilling, boring and profiling operations.

Figure 19:
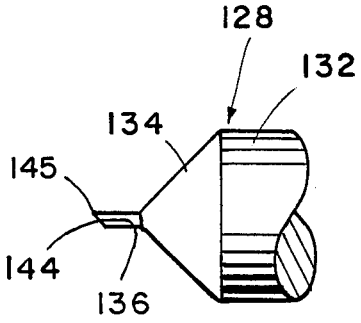
FIG. 19 is a fragmentary, side elevation of a profile milling tool/cutter useful in the milling machine of FIGS. 15 and 16 to perform the manufacturing method of the present invention.
Figure 20:
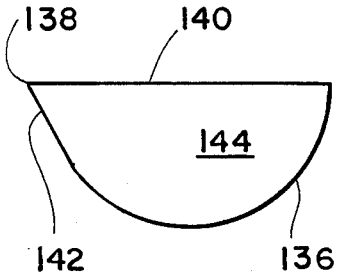
FIG. 20 is an end view of the profile milling tool/cutter of FIG. 19.

As shown in FIGS. 19 and 20, profile milling tool or cutter 128 includes a shaft or spindle 132 having a conical, tapering end 134 merging into a cutting end 136 which is generally semi-circular in section as shown in FIG. 20 but includes an extending cutting edge 138 at one side. Cutting edge 138 is formed by a diametrical, planar surface 140 and a tangential surface 142 extending outwardly from the semi-circular, cylindrical surface of cutting head 136. In addition, end surface 144 is slanted (FIG. 19) such that the cutting tip 145 of the cutting tool may trace a fine, accurate line in lens blank 12 to outline and cut lens 15 from blank 12 when rotated at high speed by spindle 126.

Figure 17:
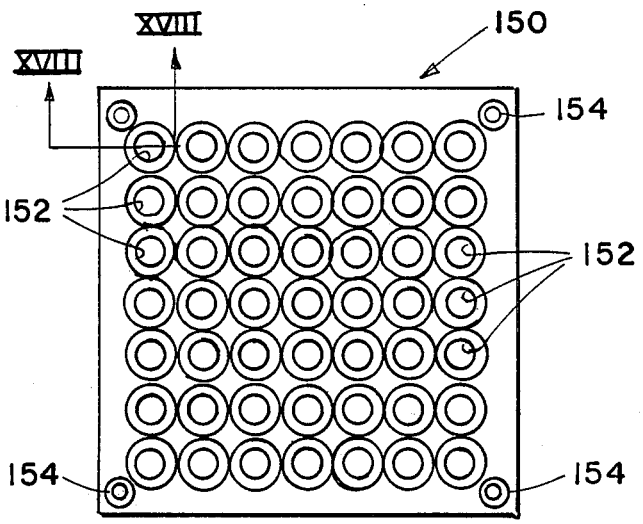
FIG. 17 is a plan view of the carrier holding fixture of the present invention as used on the milling machine of FIGS. 15 and 16.
Figure 18:
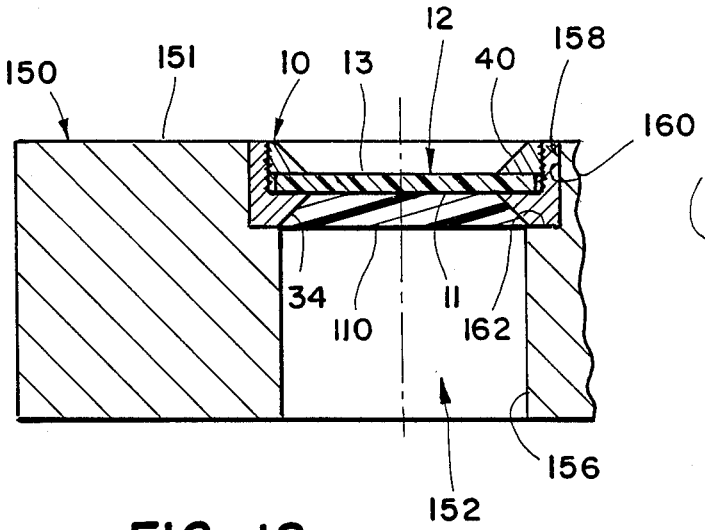
FIG. 18 is a fragmentary, sectional side elevation of the carrier holding fixture taken along plane XVIII–XVIII of FIG. 17.

With reference to FIGS. 16–18, carrier assembly 10 including lens blank 12 having one or both sides 11, 13 cut to form optical surfaces, is positioned under milling head 124 and milling tool 128 on adjustable table 122 by means of a carrier holding fixture 150. Fixture 150 is a rigid metallic plate formed from aluminum or another metal having an overall square or rectangular shape and including a plurality of carrier assembly holding and locating apertures 152 which extend through the entire thickness of the fixture. Multiple apertures 152 allow numerically controlled milling machine 120 to cut several lenses in succession from prepared lens blanks each held in a separate carrier I0 in order to save processing and handling time. Fixture 150 is secured on table 122 using fasteners 154 extending through fastening apertures. As will be understood from FIGS. 16 and 18, each holding, locating aperture 152 includes a through bore 156 and a slightly larger, annular recess 158 in the top surface of the fixture concentric with bore 156. Sidewall 60 of annular recess 158, which extends axially with respect to the axis of aperture 152, engages, positions and locates the outer peripheral surface 24 of assembly 10 and is substantially perpendicular to top surface 151 of fixture 150. Bottom wall 162 of recess 158 engages, positions and locates end surface 28 of carrier 10 when the carrier is placed in its preferred position with wax layer 110 facing downwardly in the fixture. When so positioned, carrier assembly 10 with lens blank 12 retains lens blank 12 substantially parallel to the top surface 151 of fixture plate 150 and exposes the central area of the lens blank for cutting and milling. When cutting tool 128 is rotated and brought into contact with lens blank 12, the outline of the completed lens 15 including the circular central lens portion and the locating haptics 18, 20 may be followed to cut lens 15 from blank 12. During such process, wax layer 110 which contacts the entire bottom surface of the lens blank during such operation, holds the lens in position until the complete outline is profiled. Carrier assembly 10 with lens blank 12 may then be placed in water to dissolve wax layer 110 and allow separation of the completed lens with integral haptics 18, 20 from the lens blank. To speed such removal, the dissolving water may be heated by ultrasonic heating or the like. Thereafter, the complete lens may be tumble polished in accord with conventionally known procedures to finish the optic lens surfaces and finally prepare the lens for implantation in the eye.

Accordingly, with reference to FIG. 8, the manufacture of an optical lens, and especially an intraocular lens, with the improved manufacturing method of the present invention will now be understood. Lens blank 12 is placed within annular body 22 of carrier assembly 10 against lens retaining surface 32. Clamping ring 40 is screwed into threads 36 and against the exposed side 11 of the lens blank to securely fasten and clamp the periphery of the lens blank within the carrier assembly.

Projections 70, 72 of tightening tool 60 are inserted in recesses 50, 52 and rotated by handle 64 to securely tighten the threaded clamping ring against the lens blank.

Carrier assembly 10 with lens blank 12 mounted therein is then mounted within collet chuck 90 of air bearing lathe spindle 86 on lathe 80 by sliding the carrier assembly along axial surfaces 106 of the collet chuck until end surface 26 engages surfaces 108 of the collet chuck segments. Collet chuck 90, which was previously extended to insert carrier 10, is then withdrawn into the spindle 86 to clamp the peripheral surface 24 of the carrier assembly tightly in the chuck segments. Side 13 of the lens blank, which faces outwardly from collet chuck 90, is cut with cutting tool 89 as spindle 86, collet chuck 90 and the carrier assembly and lens blank are rotated at high speeds in conventional fashion. Once the desired shape is formed on first optical surface 16, collet chuck 90 is extended from spindle 86. Carrier assembly 10 is removed from the collet chuck projections 104, and reversed, remounted and repositioned in the collet chuck with end surface 28 fitted against surfaces 108 such that opposite side 11 of the lens blank faces outwardly. Thereafter, collet chuck 90 is again withdrawn to clamp the outer peripheral surface 24 of the carrier assembly and hold the lens blank in position for cutting the second optical surface using lathe cutting tool 89 as described above.

To provide backup strength for the lens during such cutting of the second side, which may have been somewhat weakened by cutting of the first side, a wax layer 110 is applied to side 13 within inside surface 34 on carrier 10 before repositioning carrier 10 in collet chuck 90. Wax layer 110 is left in place following cutting of the second side and during the profile milling operation to hold the lens in place as it is cut from the lens blank.

After the second optical surface 14 is formed on the lens blank, the entire carrier assembly 10 is removed from collet chuck 90 and transferred to an aperture 152 on fixture plate 150 of vertical milling machine 120. Using a cutting tool such as that shown at 128 in a high speed rotational spindle 126, the outline of the completed lens 15 is traced or profiled to sever the lens from the lens blank 12 (FIG. 6). Throughout such operation, surfaces 160, 162 of annular recess 158 in the fixture plate hold and position the carrier assembly and thus lens blank 12 for proper profiling with the cutting head. Simultaneously, wax coating 110 holds the lens in place as the lens outline is followed.

After cutting of the lens from the lens blank, the carrier assembly is placed in water which preferably is heated to speed dissolving of the water soluble wax 110. Thus, completed lens 15 is separated and removed from the lens blank. Lens 15 is then tumble polished in the conventionally known manner to complete processing and manufacture of the lens and ready it for implantation in the human eye.

As will be apparent, the present manufacturing process allows preparation of one or both sides of a lens blank prior to profiling or cutting of the lens from the blank to form plano-convex, bi-convex or convex-concave lenses as desired. Locating haptics 18, 20 may be formed in one piece with the lens or separately. When formed separately, the haptics are inserted in bored or drilled holes extending tangentially into the sides of the central lens area in known manner.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows:

1. A carrier for holding an optical lens blank having a central area and a periphery while optical surfaces are formed on the blank, said carrier comprising:

a rigid body having an outer peripheral surface, first and second spaced end surfaces, and an inside surface defining an aperture extending through said body on an axis, said outer peripheral surface and said spaced end surfaces being adapted to accurately locate said carrier on a tool for machining the lens blank surfaces;

lens blank holding means mounted on said rigid body for holding at least portions of the periphery of a lens blank within said body, said lens blank holding means extending axially toward the exterior of said rigid body no further than flush with one of said end surfaces when mounted on said rigid body;

said carrier being reversible to allow use of each of said spaced end surfaces for locating said carrier on a tool for machining the lens blank surfaces and to allow access to the central lens blank area from adjacent each end surface without removing said lens blank holding means from said rigid body such that opposite surfaces of the central area of the lens blank are exposed and accessible when said carrier is reversed for performing operations to form optical surfaces on the lens blank.

2. The carrier of claim 1 wherein said holding means include a rigid clamping member received within said body and securing means for releasably securing said clamping means to said body; said body including a lens blank retaining surface therein positioned intermediate said end surfaces; said clamping member including an end surface for engaging the lens blank and holding the blank against said lens blank retaining surface.

3. The carrier of claim 2 wherein said aperture in said body is circular; said clamping member being annular and having a circular aperture therethrough corresponding in size to said aperture in said body; said securing means including a threaded outer surface on said clamping member and a correspondingly threaded inside surface on said body.

4. The carrier of claim 3 including means on said clamping member for receiving a tool for tightening said clamping member inside said body against a lens blank.

5. The carrier of claim 1 wherein said first and second end surfaces are parallel to one another.

6. The carrier of claim 5 wherein said outer peripheral surface is perpendicular to said end surfaces.

7. The carrier of claim 6 wherein said rigid body is annular, said outer peripheral surface being cylindrical, said aperture through said body being circular.

8. The carrier of claim 7 wherein said holding means include a radially extending lens blank retaining surface positioned intermediate and parallel to said end surfaces; said inside surface extending at an angle to one of said end surfaces and terminating at said lens blank retaining surface.

9. The carrier of claim 8 wherein said holding means further include a threaded clamping ring for clamping the periphery of a lens blank against said lens blank retaining surface.

10. The carrier of claim 1 wherein said holding means include a threaded clamping ring and threads on said inside surface of said rigid body for receiving said clamping ring.

11. The carrier of claim 10 wherein said clamping ring has a threaded outside surface, an end surface for engaging a lens blank and an inside surface extending at an angle to said end surface to define an aperture through said clamping ring.

12. The carrier of claim 11 wherein said aperture through said body and said aperture through said clamping ring are circular and of equivalent diameter.

13. The carrier of claim 10 including means on said clamping ring for receiving a tool for tightening said clamping ring to said body.

14. A carrier for holding an optical lens blank while forming optical surfaces on the blank, said carrier being reversible for access to the lens blank from either side, said carrier comprising:

an annular body having a cylindrical outside surface, first and second spaced, parallel end surfaces, an inside surface defining an aperture extending through said body on an axis, and a lens blank retaining surface positioned axially intermediate said end surfaces, said outside surface and said end surfaces being adapted to accurately locate said carrier on a tool for machining the lens blank surfaces;

an annular lens blank retaining member received in said annular body and having an outside surface, an inside surface defining an aperture through said member and an end surface; and securing means for securing said retaining member in said annular body;

said lens blank retaining member extending axially away from said lens blank retaining surface to a position no further than flush with one of said end surfaces of said annular body when secured by said securing means and retaining a lens blank in said body;

whereby when a lens blank is received within said body against said lens blank retaining surface, said retaining member is received and secured within said annular body with said securing means to hold the periphery of the lens blank between said end surface of said retaining member and said lens blank retaining surface whereby opposite surfaces of a central area of the lens blank are exposed and accessible through said apertures when said carrier is reversed for performing operations to form optical surfaces on the lens blank.

15. The carrier of claim 14 wherein said securing means include threads on said outer surface of said retaining member and corresponding threads on said inside surface of said body adjacent said lens blank retaining surface.

16. The carrier of claim 15 including means on said lens blank retaining member for receiving a tool for tightening said retaining member to said body.

17. The carrier of claim 14 wherein said lens blank retaining surface extends parallel to said first and second end surfaces of said annular body.

18. The carrier of claim 14 wherein said inside surfaces of said body and retaining member converge toward one another and a position intermediate said end surfaces of said body and spaced radially inwardly of said cylindrical outside surface of said body.

19. A method for manufacturing an optical lens from a lens blank comprising:

positioning and holding an optical lens blank in a rigid carrier having an outer peripheral surface and an end surface such that opposite sides of a predetermined area of said lens blank are exposed by said carrier;

mounting said carrier with said lens blank on a rotating support having a rotational axis using said end surface and said outer peripheral surface to locate and position said carrier with respect to said rotational axis by contacting said end and outer peripheral surfaces against corresponding surfaces on the rotating support such that one of said exposed sides of said lens blank faces outwardly; and cutting an optical surface in said outwardly facing lens blank surface with a cutting tool whereby said optical surface is precisely and accurately formed with respect to said rotational axis.

20. The method of claim 19 including repositioning said carrier and lens blank on said rotating support using said outer peripheral surface and a second end surface on said carrier which is spaced from said first end surface to locate and position said carrier with respect to the rotational axis by contacting said second end surface and said outer peripheral surface against corresponding surfaces on the rotating support such that the opposite one of said sides of said lens blank faces outwardly; and cutting an optical surface in said outwardly facing opposite side of said lens blank with a cutting tool whereby said two cut optical surfaces are precisely aligned and positioned with one another after cutting for accurate optical resolution.

21. The method of claim 20 wherein said positioning and holding step includes positioning said lens blank intermediate said end surfaces of said carrier and clamping at least portions of the periphery of said lens blank with a clamping member in said carrier such that the central area of said lens blank is exposed.

22. The method of claim 21 wherein said lens blank is a sheet of optical lens material; said clamping member being threaded; said clamping step including tightening said threaded clamping member against one side of said sheet of lens material adjacent the edge of said sheet such that said clamping member projects outwardly no further than flush with an end surface of said carrier, said clamping member pressing the opposite side of said sheet adjacent the sheet periphery against a lens blank retaining member intermediate said end surfaces of said carrier.

23. The method of claim 21 wherein said mounting step includes placing said carrier on said rotating support with said clamping member facing inwardly toward said support.

24. The method of claim 23 wherein said mounting step includes positioning said carrier in a self-centering collect on a lathe such that said collect engages said outer peripheral surface and said first end surface.

25. The method of claim 20 including coating said cut optical surface with wax prior to said repositioning step.

26. The method of claim 20 including cutting a lens from said lens blank after both said optical surfaces have been formed.

27. The method of claim 26 wherein said cutting of said lens from said lens blank includes mounting said carrier on a milling machine after both said optical surfaces have been formed using said outer peripheral surface and said second end surface to locate and position said carrier and lens blank by contacting said outer peripheral surface and said second end surface against corresponding surfaces on the milling machine, and cutting the outline of said lens in said lens blank with a cutting tool on said milling machine to remove said lens from said lens blank.

28. The method of claim 27 including coating said cut optical surface with wax prior to said repositioning step; said mounting of said carrier in said milling machine including positioning of said carrier with said wax coated optical surface facing away from said cutting tool.

29. The method of claim 27 including tumble polishing said lens after cutting from said lens blank.

30. A method for manufacturing an optical lens from a lens blank comprising:

positioning and holding an optical lens blank in a rigid carrier having an outer peripheral surface and first and second parallel end surfaces such that opposite sides of a predetermined area of said lens blank are exposed by said carrier;

mounting said carrier with said lens blank on a rotating support having a rotational axis using one of said end surfaces and said outer peripheral surface to locate and position said carrier with respect to said rotational axis by contacting one of said end and said outer peripheral surfaces against corresponding surfaces on the rotating support such that one of said exposed sides of said lens blank faces outwardly; and cutting an optical surface in said outwardly facing lens blank surface with a cutting tool;

repositioning said carrier and lens blank on said rotational support using the other of said end surfaces and said outer peripheral surface to locate and position said carrier with respect to the rotational axis by contacting said other of said end surfaces and said outer peripheral surface against corresponding surfaces on the rotating support such that the opposite one of said sides of said lens blank faces outwardly;

cutting an optical surface in said outwardly facing opposite side of said lens blank with a cutting tool; and mounting said carrier on a milling machine after both said optical surfaces have been cut using said outer peripheral surface and one of said end surfaces to locate and position said carrier and lens blank by contacting said outer peripheral surface and said one of said end surfaces against corresponding surfaces on the milling machine and cutting the outline of said lens in said lens blank with a cutting tool on said milling machine whereby said two cut optical surfaces are precisely aligned and positioned with respect to one another after manufacture for accurate optical resolution.

31. A carrier for holding an optical lens blank having a central area and a periphery while optical surfaces are formed on the blank, said carrier comprising:

a rigid body having an outer peripheral surface, first and second spaced end surfaces, and an inside surface defining an aperture extending through said body;

lens blank holding means on said rigid body for holding at least portions of the periphery of a lens blank within said body, said lens blank holding means including an aperture extending therethrough corresponding in size to said aperture in said rigid body;

said carrier being reversible to allow use of each of said spaced end surfaces for locating said carrier on a tool for machining the lens blank surfaces and to allow access to the central lens blank area from adjacent each end surface thereof without removing said lens blank holding means from said rigid body such that opposite surfaces of the central area of the lens blank are exposed and accessible through said apertures in said rigid body and lens blank holding means when said carrier is reversed for performing operations to form optical surfaces on the lens blank.

* * * * *

UNITED STATES PATENT AND TRADEMARK OFFICE

CERTIFICATE OF CORRECTION

PATENT NO. : 4,856,234

DATED : August 15, 1989

INVENTOR(S) : Gary D. Goins

It is certified that error appears in the above-identified patent and that said Letters Patent is hereby corrected as shown below:

Column 3, line 31:

After "4" delete --.--.

Figure 11:
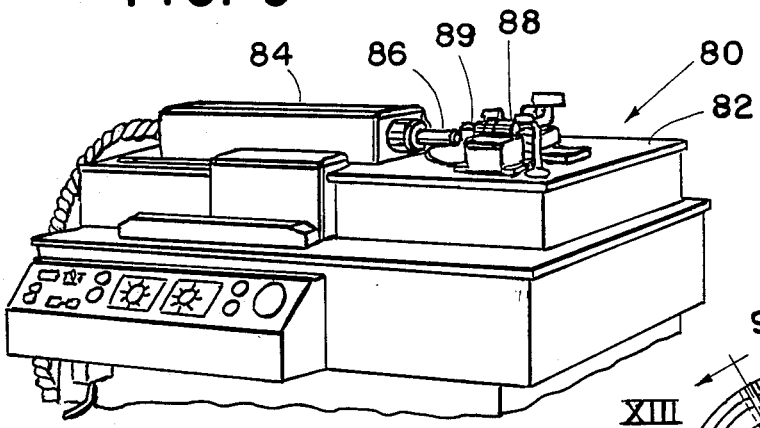
FIG. 11 is a fragmentary perspective view of a computer operated, numerically controlled lathe suitable for use in performing the method of the present invention.

Column 3, line 58:

"Fig. 11:" should be --Fig. 11;--.

Column 6, line 1:

"It Will" should be --It will--.

Column 7, line 65:

"15 milling" should be --milling--.

Column 12, line 59:

"collect" (first occurrence) should be --collet--.

UNITED STATES PATENT AND TRADEMARK OFFICE

CERTIFICATE OF CORRECTION

PATENT NO. : 4,856,234

DATED : August 15, 1989

INVENTOR(S) : Gary D. Goins

It is certified that error appears in the above-identified patent and that said Letters Patent is hereby corrected as shown below:

Column 12, line 59:

"collect" (second occurrence) should be --collet--.

Signed and Sealed this

Nineteenth Day of February, 1991

*Attest:*

HARRY F. MANBECK, JR.

*Attesting Officer*

*Commissioner of Patents and Trademarks*